US010043388B1

(12) United States Patent
Kahn et al.

(10) Patent No.: US 10,043,388 B1
(45) Date of Patent: Aug. 7, 2018

(54) PARKING SYSTEM

(71) Applicants: Philippe Richard Kahn, Santa Cruz, CA (US); Arthur Kinsolving, Santa Cruz, CA (US); David Vogel, Santa Cruz, CA (US); Mark Andrew Christensen, Santa Cruz, CA (US)

(72) Inventors: Philippe Richard Kahn, Santa Cruz, CA (US); Arthur Kinsolving, Santa Cruz, CA (US); David Vogel, Santa Cruz, CA (US); Mark Andrew Christensen, Santa Cruz, CA (US)

(73) Assignee: DP Technologies, Inc., Scotts Valley, CA (US)

( * ) Notice: Subject to any disclaimer, the term of this patent is extended or adjusted under 35 U.S.C. 154(b) by 329 days.

(21) Appl. No.: 14/281,849

(22) Filed: May 19, 2014

Related U.S. Application Data

(60) Provisional application No. 61/828,674, filed on May 29, 2013.

(51) Int. Cl.
*G08G 1/14* (2006.01)

(52) U.S. Cl.
CPC ..... *G08G 1/141* (2013.01); *G08G 1/143* (2013.01); *G08G 1/144* (2013.01)

(58) Field of Classification Search
None
See application file for complete search history.

(56) References Cited

U.S. PATENT DOCUMENTS

| | | | | |
|---|---|---|---|---|
| 2005/0216557 | A1 | 9/2005 | Ohwa et al. | |
| 2006/0136131 | A1* | 6/2006 | Dugan et al. | 701/300 |
| 2006/0173752 | A1 | 8/2006 | Bowlus et al. | |
| 2006/0250278 | A1 | 11/2006 | Tillotson et al. | |
| 2007/0118415 | A1 | 5/2007 | Chen et al. | |
| 2007/0282661 | A1 | 12/2007 | Franco | |
| 2008/0136674 | A1* | 6/2008 | Jang et al. | 340/932.2 |
| 2008/0172173 | A1 | 7/2008 | Chang et al. | |
| 2009/0100037 | A1 | 4/2009 | Scheibe | |
| 2009/0125229 | A1 | 5/2009 | Peri et al. | |
| 2009/0187340 | A1* | 7/2009 | Vavrus et al. | 701/210 |
| 2009/0187341 | A1* | 7/2009 | Vavrus et al. | 701/210 |
| 2009/0187342 | A1* | 7/2009 | Vavrus et al. | 701/210 |
| 2009/0254843 | A1 | 10/2009 | Wie et al. | |
| 2009/0276318 | A1 | 11/2009 | Broadbent et al. | |
| 2010/0015993 | A1 | 1/2010 | Dingler et al. | |
| 2010/0082247 | A1 | 4/2010 | Klein et al. | |
| 2010/0190510 | A1 | 7/2010 | Maranhas et al. | |
| 2010/0211425 | A1 | 8/2010 | Govindarajan | |
| 2010/0253541 | A1 | 10/2010 | Seder et al. | |
| 2010/0302068 | A1* | 12/2010 | Bandukwala | 340/932.2 |
| 2011/0106425 | A1* | 5/2011 | Trum et al. | 701/201 |
| 2011/0172909 | A1* | 7/2011 | Kahn et al. | 701/202 |
| 2012/0041672 | A1 | 2/2012 | Curtis et al. | |
| 2012/0265874 | A1* | 10/2012 | Hoh et al. | 709/224 |

(Continued)

*Primary Examiner* — Julie Lieu
(74) *Attorney, Agent, or Firm* — HIPLegal LLP; Judith Szepesi

(57) ABSTRACT

A method of managing a parking system comprising receiving a request for a parking location from a user of a mobile device, selecting an available spot, and guiding the user to the available spot. The method in on embodiment further comprises marking the parking location. In one embodiment, the user may also be given guidance back to the marked parking location.

21 Claims, 6 Drawing Sheets

(56) References Cited

U.S. PATENT DOCUMENTS

| | | | | |
|---|---|---|---|---|
| 2014/0156183 | A1* | 6/2014 | Windeler et al. | 701/454 |
| 2014/0213176 | A1* | 7/2014 | Mendelson | 455/39 |
| 2014/0232570 | A1* | 8/2014 | Skinder et al. | 340/989 |
| 2014/0266800 | A1* | 9/2014 | Koukoumidis et al. | 340/932.2 |
| 2014/0309917 | A1* | 10/2014 | Beaurepaire et al. | 701/300 |
| 2015/0124096 | A1* | 5/2015 | Koravadi | 348/148 |
| 2015/0213716 | A1* | 7/2015 | Aggarwal | G07B 15/02 340/932.2 |

* cited by examiner

PARKING SYSTEM

RELATED APPLICATIONS

The present application claims priority to U.S. Provisional Application No. 61/828,674, filed on May 29, 2013, and incorporate that application by reference.

FIELD

The present invention relates to parking of vehicles, and more particularly to using a location-aware device to enhance parking.

BACKGROUND

Global positioning system (GPS) based navigation systems are becoming more common. Users can rely on receiving guidance to their destination, for anywhere. However, generally, when the user arrives at the destination, he or she must find a parking place. This can be a complicated, and time-consuming search, especially in cities where parking is scarce.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

The present invention provides a system that enables drivers to find parking spaces, in one embodiment. The system may include an application on a user's mobile device, a special purpose device, or a software update to a built-in GPS navigation system. The system, in one embodiment, guides a user to a vacant parking spot, stores the parking spot's location when the user leaves the vehicle, and guides the user back to the parking spot. In one embodiment, the system also reports the vacant spot when the user drives off. In this way, the system provides an integrated parking system, which manages open spots, speeds up user interactions, and increases the satisfaction of users.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1:
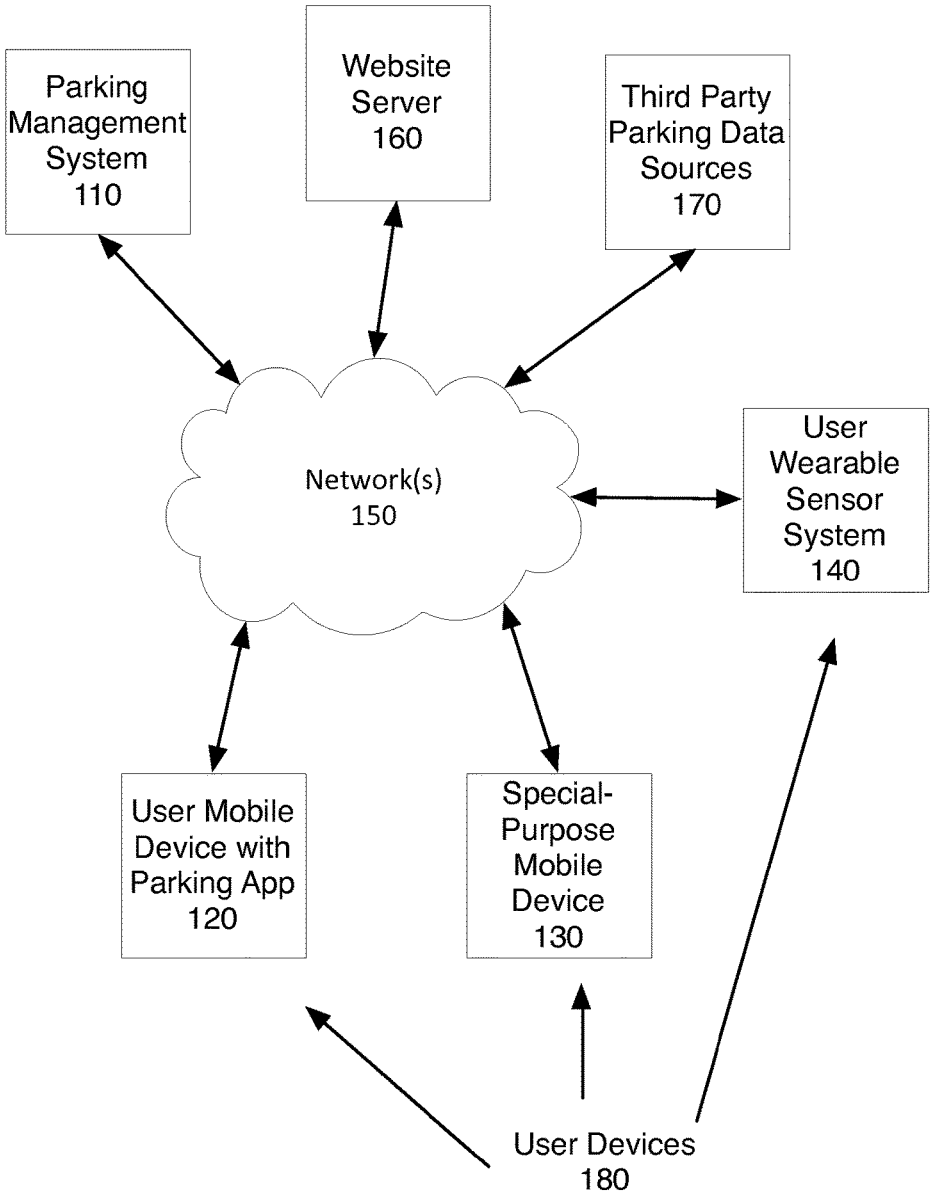
FIG. 1 is a system diagram of one embodiment of the elements that may interact in the system.

FIG. 1 is a system diagram of one embodiment of the elements that may interact in the system. In one embodiment a parking management system 110 tracks availability of parking spaces in a defined area. For example, a parking management system may interact with a plurality of parking garages or other parking locations. In one embodiment, the system may receive data from third party parking data sources 170. For example, SFPARK™ has parking data for San Francisco, receiving data from embedded pavement sensors for vacancy. Other third party parking data sources 170 may include parking meter data, data from cameras, user-reported data, or other data sources.

Although the discussion here focuses on parking for cars or similar vehicles, one of skill in the art would understand that this technique is applicable to parking other vehicles, such as boats or ships or airplanes. Additionally, the technique may be applicable to finding a location for other movable objects, such as shipping crates or containers.

The parking management system 110, in one embodiment, may provide the data on available parking locations to a website server, so that a user may check availability via a data connection, such as an application or web browser. The parking management system 110, in one embodiment, is implemented by a server. In one embodiment, the parking management system may manage parking availability for a particular parking garage or parking area, for a plurality of parking garages and/or areas, for an entire city, county, etc.

In one embodiment, the user may utilize a user mobile device with a parking application 120, a special purpose device 130, or a user wearable sensor system 140. In one embodiment, he system may be incorporated into any mobile device, or in-vehicle device, which is capable of providing guidance. In one embodiment, the device 120, 130, 140 is also capable of detecting when the user is driving or has parked. In one embodiment, the mobile device 120 is a smart phone, and the system utilizes an application on the smart phone.

In one embodiment, instead of using a separate parking management system 110, the system uses peer-to-peer communication between user devices 180, to track parking space availability and to implement the system. In one embodiment, parking space availability may be communicated based on user input and/or data from a third party system.

Figure 2:
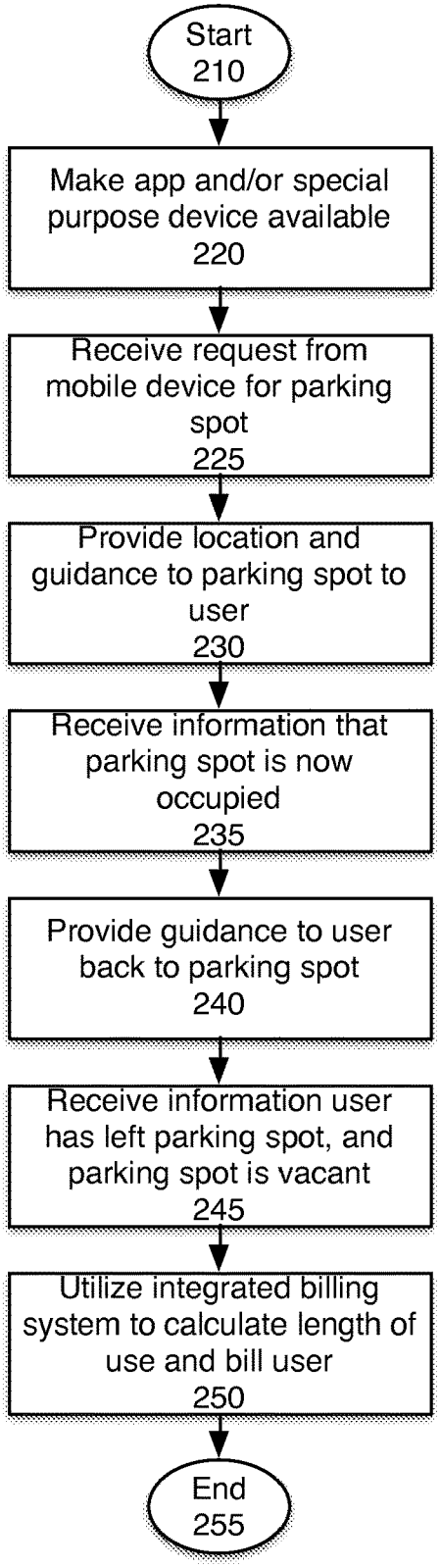
FIG. 2 is an overview flowchart of using the system.

FIG. 2 is an overview flowchart of using the system. The process starts at block 210. At block 220, the application or special purpose device is made available. In one embodiment, the application may be an application downloadable to a mobile device such as a smart phone or tablet device. In one embodiment, the special purpose device may be a device made available by the parking system. In one embodiment, for a larger parking system, the special purpose device may be provided when a user drives their vehicle into the parking garage/system. In one embodiment, the system may be incorporated into existing systems which can be used to track users such as FASTRAK® or similar toll payment system.

At block 225, a request is received from the mobile device for a parking spot. In one embodiment, the request includes the mobile device's current location. In one embodiment, this request may be generated when the user confirms that he or she is near a destination and will want parking. In another embodiment, this request may be automatically generated, when the user nears his or her destination, if that destination is not a residence, or other location with on-site parking.

At block 230, a location of an available parking spot is provided to the mobile device. In one embodiment, the system also provides guidance to the parking spot to the user's device. In one embodiment, the system may send a location to the mobile device, and the mobile device calculates the directions and provides guidance. In another embodiment, the system may provide guidance based on the mobile device's current location, and the destination parking spot. In one embodiment, the location sent may be a latitude/longitude. In one embodiment, the location sent may be a parking space number if the guidance system has a map of the parking locations. In one embodiment, when a user is being guided to a parking spot, that parking spot is marked as "reserved" and no other users are guided to the parking spot, until the user either leaves the parking spot or has passed up the parking spot.

At block 235, the system receives an update from the mobile device that the parking spot is now occupied. In one embodiment, the information is sent when the mobile device detects that the user has exited the vehicle. In one embodiment, this is detected based on motion sensors in the device. In one embodiment, the update includes an identification of the parking spot that is occupied, so that if the user parked in a different spot the correct spot is marked by the system. At this point, the parking spot is marked as occupied.

At block 240, upon request the system may provide guidance back to the parking spot to the user. Users often forget exactly where they were parked. Therefore, providing guidance back to the parking spot helps the user.

At block 245, the system receives data that the user has left the parking spot. The parking spot is then marked as vacant. In one embodiment, the mobile device detects when the user switches from ambulatory to driving, and sends notice to the parking system that the parking spot has been left.

In one embodiment, if not all drivers have the parking system application, a parking spot vacancy has associated with it a timing-based probability. Immediately after a user leaves a parking spot, it is 100% certain that the parking spot is vacant. However, as additional cars enter the parking system, the probability of the parking spot remaining vacant decreases. In one embodiment, this probability is taken into account when selecting parking spots to which requesting drivers are directed.

At block 250, in one embodiment the system uses an integrated billing system to calculate the length of the use of the parking spot, and bill the user. In one embodiment, the system enables billing by actual parked time. First, because this utilizes the mobile device the user may be able to pay more quickly and easily. Second, because this billing system eliminates the need to pay for time spent looking for a parking spot, the user would have a better experience. Additionally, it speeds up leaving the parking spot, because the user need not handle the payment either prior to getting back in the art or prior to exiting the parking structure. This increases parking spot availability as well. The process then ends at block 255.

One of ordinary skill in the art will recognize that the process described with respect to FIG. 2 is a conceptual representation of the parking system operation. The specific operations of the process may not be performed in the exact order shown and described. The specific operations may not be performed in one continuous series of operations, and different specific operations may be performed in different embodiments. Furthermore, the process could be implemented using several sub-processes, or as part of a larger macro process. For instance, in some embodiments, the process is performed by one or more software applications that execute on one or more computers. Furthermore, the process may be distributed between a mobile device and a server in various ways.

Figure 3:
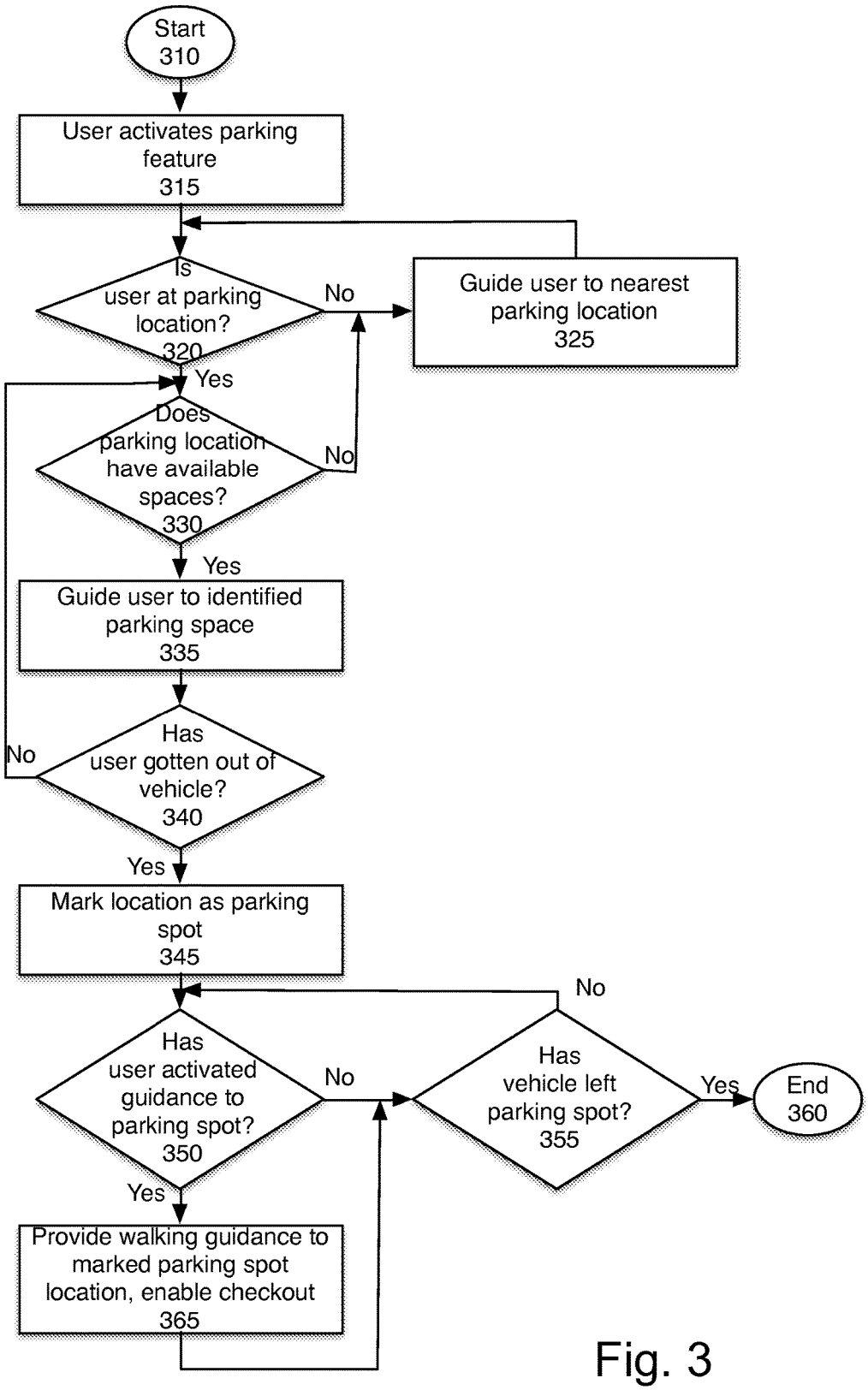
FIG. 3 is a flowchart of one embodiment of interaction between a user and a guiding device.

FIG. 3 is a flowchart of one embodiment of interaction between a user and a guiding device. The process starts at block 310. The process starts when the user activates the parking feature 315. In one embodiment, the parking feature is automatically activated when the user utilizes a navigation application including parking feature, and the user approaches the destination. In one embodiment, the parking feature is a separate application. In one embodiment, the user manually activates the parking feature. In one embodiment, the system may query the user, when the user approaches a destination using a navigation application, whether the user wishes to engage the parking feature.

At block 320, the process determines whether the user is at a parking location. The parking location may be a parking garage, a parking lot, or on a street that includes parking. If the user is not yet at a parking location, at block 325, the system provides guidance to the parking location. In one embodiment, the system selects a nearest parking location that has available spaces. In one embodiment, the system selects a nearest parking location that has at least a certain number of available spaces.

If the user is at the parking location, at block 330, the process again determines if there are spaces available. In one embodiment, this may be tested when the user is driving toward a parking location as well. If the parking location is updated to indicate that there are no remaining parking places, the user may be rerouted to another parking location.

At block 335, the user is guided to a parking spot. In general, the user would be guided to the nearest available parking spot from the entrance.

At block 340, the process determines whether the user has gotten out of the vehicle, when he or she arrives at the guided-to parking spot. If the user does not get out, but continues to drive, the system determines that the parking spot was not available after all. In one embodiment, the system marks that parking spot as unavailable. The process then returns to block 335, to determine whether there are parking spaces are available in the parking location, and to guide the user to another parking spot.

If the user gets out of the vehicle, the process continues to block 340. In one embodiment, this is determined using a sensor worn by the user, such as a smart phone or wristband that registers the user's movements and can recognize the movements associated with the user getting out of the car. In one embodiment, this may be done with other sensors, such as a door sensor in the vehicle. In one embodiment, other sensors may be used to detect the user getting out of the vehicle. In one embodiment, the user manually indicates that he or she is getting out of the car.

At block 345, the system marks the location as the parking spot. In one embodiment, the system also marks the parking spot as occupied, so that no other users are guided to that spot.

The user in one embodiment is then provided guidance to their original destination, from the parking spot. In one embodiment, the system automatically calculates the directions to the prior destination. In another embodiment, when the parking spot is saved, the system queries the user whether he or she wishes to receive walking directions to their prior parking spot.

At block 350, the process determines whether the user has activated guidance back to the parking spot. This would occur when the user is returning to his or her vehicle. If the user has not activated guidance to the parking spot, the process continues to block 355.

At block 355, the process determines whether the vehicle has left the parking spot. In on embodiment, GPS or similar location systems associated with the user is used to make this determination. In one embodiment, sensors in the vehicle are used to make this determination. In another embodiment, the user's vehicle exiting the parking structure is used for this determination. In one embodiment, the user completing payment for the parking may be used. In one embodiment, the user entering a new destination into the guidance system associated with the parking feature used to make this determination. In another embodiment, other data from sensors or user input may be used.

If the vehicle has left the parking spot, the process ends at block 360. The process, in one embodiment, marks the parking spot as available again.

If the vehicle has not yet left the parking spot, the process returns to block 350, to determine whether the user has activated guidance back to the parking spot. If the user activates guidance, as determined at block 350, the process continues to block 365.

At block 365, the user is provided walking guidance to the marked parking location. In one embodiment, the guidance to the parking spot provides detailed guidance, including for example the floor on which the vehicle is located. In one embodiment, the user may be able to pay for the parking cost, using the parking application/feature. The process then continues to block 355, to determine whether the user's vehicle has left the parking spot.

In this way, the system provides guidance to the user, and enables the user to easily and quickly find a parking spot, and return to the parking spot. This minimizes the cost to the user. It also enables the manager of the parking facility to maximize revenue by reducing user frustrating and increasing utilization of parking spots.

One of ordinary skill in the art will recognize that the process described with respect to FIG. 3 is a conceptual representation of the parking system operation from the perspective of the parking application/feature. The specific operations of the process may not be performed in the exact order shown and described. The specific operations may not be performed in one continuous series of operations, and different specific operations may be performed in different embodiments. Furthermore, the process could be implemented using several sub-processes, or as part of a larger macro process. For instance, in some embodiments, the process is performed by one or more software applications that execute on one or more computers. Furthermore, the process may be distributed between a mobile device and a server in various ways.

Figure 4:
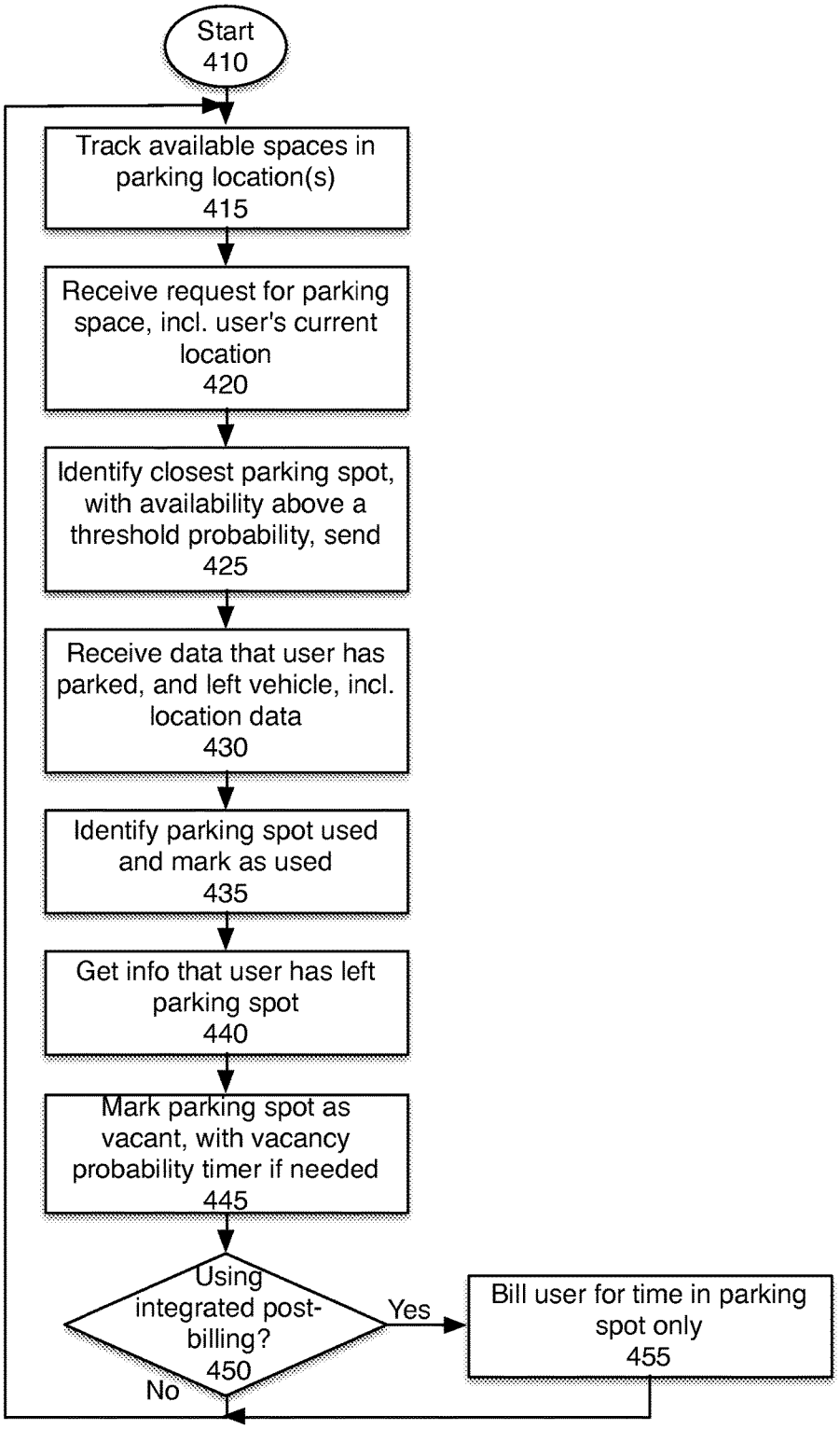
FIG. 4 is a flowchart of one embodiment of interaction between a parking operator and the management system.

FIG. 4 is a flowchart of one embodiment of interaction between a parking operator and the management system. The process starts at block, 410. In one embodiment, this process is active when a parking feature/application is available to one or more users. The parking operator in one embodiment may be a city, county, or a private operator. In one embodiment, a plurality of private and/or public parking location operators may work together to provide the parking feature/application.

At block 415, the available spaces are tracked in one or more parking locations. In one embodiment, this may be done automatically based on weight sensors, cameras, or other data inputs. In one embodiment, for parking structures, this may be done based on the user exiting the structure, as monitored by the system. In one embodiment, this may be tracked based on users paying their parking bills. Other methods of identifying open spots may be used.

At block 420, the system receives a request for a parking space, from the parking feature. In one embodiment, the request includes the user's current location.

At block 425, the system identifies the nearest parking spot that has an availability probability above a threshold. In one embodiment, parking spots are assumed to be available unless someone else has been guided to them. In one embodiment, the system may include real-time availability data based on cameras, weight sensors, or other sensors. However, in another embodiment, no real-time availability determination is possible. In that embodiment, parking spots are marked as available when a user leaves them, and the probability that they remain available decreases over time.

At block 430, the system receives data that the user has parked, and left the vehicle. In one embodiment, the data includes location data for the user's vehicle. In one embodiment, the data includes confirmation that the user has parked in the designated parking spot.

At block 435, the parking spot used by the user is marked as occupied. In one embodiment, this is done based on location data from the vehicle/parking application. In one embodiment, if the parking spot is not the one that the user was being guided to, the system re-opens the prior parking spot. In one embodiment, if full travel data is available for the user, the system determines whether the user drove past the closest parking spot designated for the user. If so, in one embodiment, the system marks that spot occupied as well. Generally, users would not drive by a usable spot that is nearer their intended destination, so the system can assume that the spot is occupied or obstructed.

At block 440, the system receives information that the user has left the parking spot. In one embodiment, the parking application provides this data to the system, based on sensor data such as motion and location data. In one embodiment, when the user pays for the parking, the system is informed that the user has left the parking spot. In one embodiment, an independent sensor such as a weight sensor or camera may be used make this determination.

At block 445, the parking spot is marked as vacant. If the system cannot track individual parking spots, except by users of the parking application, then a vacancy probability timer may also be associated with the vacant marking. In one embodiment, the system utilizes an exponential decay curve. In another embodiment, the system uses a logarithmic curve. In another embodiment, the system has two or more probability values, associated with different time frames. In that embodiment, the system decreases the probability in two or more equal segments. For example, one division may be:

time unit one the probability is assumed to be 100% that the spot is open, time unit two the probably is assumed to be 66%, after unit two the probability is assumed to be 33%, until actual data is received about the spot.

In one embodiment, the system uses a cumulative probability calculation for available parking spots. That is, if there are at least three parking spots with 33% probability of an available spot, the cumulative likelihood of a spot is increased. In one embodiment, the system simply adds probabilities, e.g. three spots at 33% probability means that there is a 99% probably that one spot is open. In another embodiment, the probability addition is discounted, e.g. each 33% probable space increases the changes of as an open spot by N*33.%, where N may be 0.5 or another number below 1. Other ways of calculating the vacancy probability may be used.

At block 450, the process determines whether the system uses an integrated post-billing system. Post-billing means that the user is billed automatically when the vehicle leaves the parking spot. In one embodiment, this enables, at block 455, for the user to be billed for the actual time in the parking spot. Instead of billing from the time the user enters the parking garage until the user exits the garage, the system can bill the user only for the actual time in the parking spot. This not only increases user flow-through, it also increase user satisfaction. The process then returns to block 415, to continue tracking available parking spots.

Although FIG. 4 is shown as a flowchart, one of ordinary skill in the art will recognize that the process described is a conceptual representation of the parking system operation. The steps described may be performed in parallel or different order, when they are not directly dependent on each other. In one embodiment, the process is interrupt driven, such that each of the actions is taken in response to data or request. For example, the system may continuously track available spaces, including the vacancy probability for each of the spaces. The request for a parking space would be a message initiated from the user's device. Similarly, the information that the user has left a parking spot may be received as an interrupt. Thus, the specific operations may not be performed in one continuous series of operations, and different specific operations may be performed in different embodiments. Furthermore, the process could be implemented using several sub-processes, or as part of a larger macro process. For instance, in some embodiments, the process is performed by one or more software applications that execute on one or more computers. Furthermore, the process may be distributed between a mobile device and a server in various ways.

Figure 5:
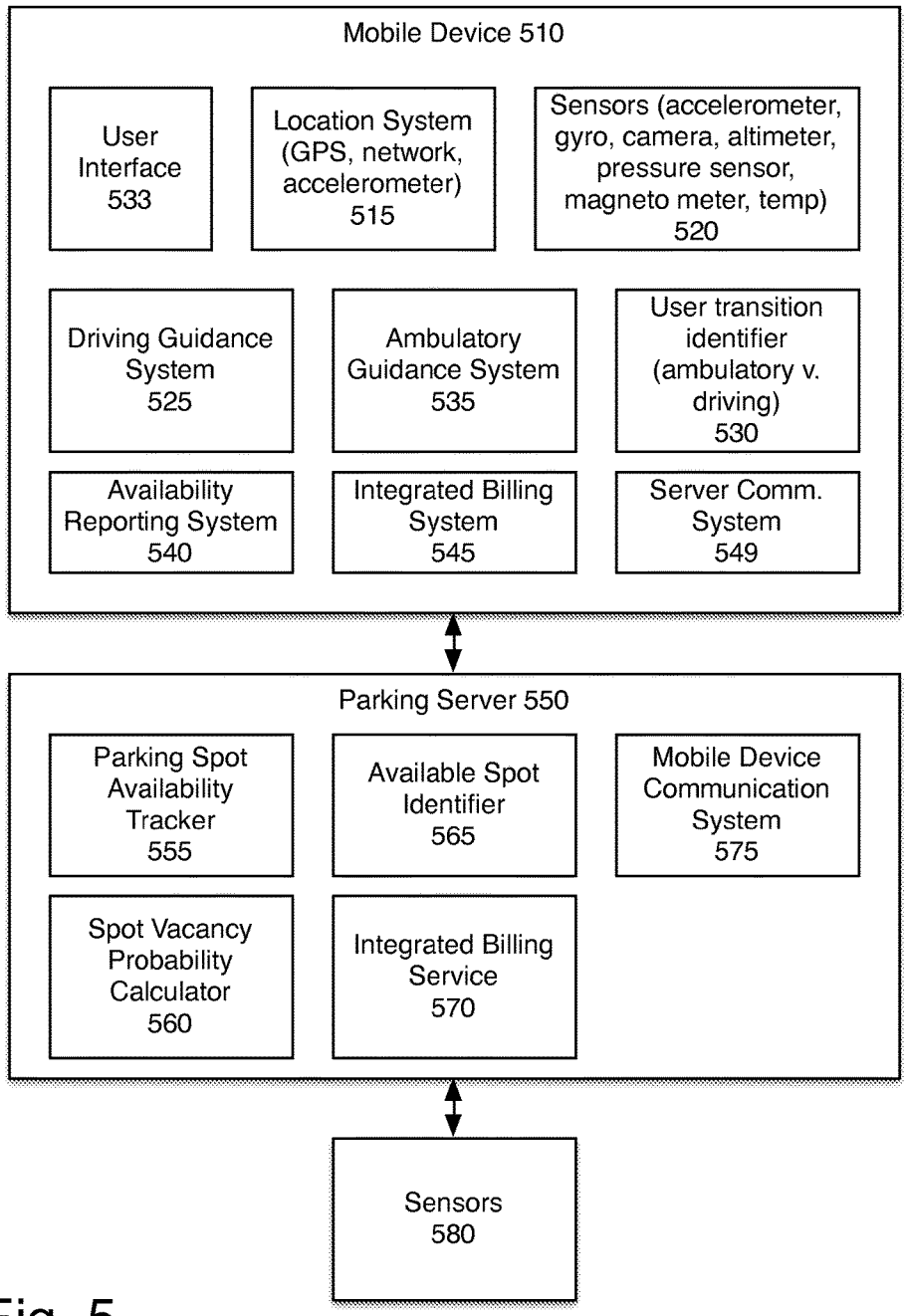
FIG. 5 is a block diagram of one embodiment of the system.

FIG. 5 is a block diagram of one embodiment of the system. The system includes a mobile device 510 and a parking server 550, in one embodiment.

The mobile device 510 may be a smart phone, a GPS system, a tablet computer, etc. In one embodiment, the mobile device 510 may be built into a vehicle, e.g. a built-in GPS system including these application features.

The mobile device 510 includes, or receives data from, location system 515. Location system 515 may be a GPS (global positioning system), network triangulation, wireless mapping, or other system to determine the approximate location of the user. In one embodiment, the location system 515 includes an accelerometer, which may be used to determine location. In one embodiment, location system 515 uses a combination of data from different location system aspects, to generate accurate location data for the user.

In one embodiment, the mobile device 510 also includes one or more sensors 520. These sensors 520 may include one or more of an accelerometer, gyroscope, camera, altimeter, pressure sensor, magnetometer, thermometer, and other sensors. The sensors 520 in one embodiment are used to detect the vehicle in motion, the user getting into and out of the vehicle. In one embodiment, if sensors 520 include a camera that is capable of observing the user's environment, e.g. a camera mounted in a way to enable the system to "see" parking location availability, this data may be reported to parking server 550. In one embodiment, the camera may be turned on periodically. In one embodiment, the camera may be turned on when the user is approaching a designated empty parking spot. This enables the system to validate the vacancy of the spot, and update the tracking data in the parking server 550.

In one embodiment, sensors 520 may also be used for other reasons. In one embodiment, the mobile device 510 may include a smart phone and a body-worn device such as a wristband or similar device that may provide additional sensors and information about the user's movements.

Server communication system 549 communicates data between the mobile device 510 and other devices, such as parking server 550. In one embodiment, the server communication system 549 is a network connection. In one embodiment, the network connection may use a cellular network connection. In another embodiment, the network connection may be a wireless network connection. Server communication system 549 may be a combination of communication systems, such that the system communicates via local are network, wireless network, and/or cellular network depending on what is available and most cost and power effective.

In one embodiment, mobile device 510 includes guidance systems 525, 535. Guidance systems 525, 535 include driving guidance system 525 and ambulatory guidance system 535. In one embodiment, a single guidance system may provide both driving and walking directions, and may thus act as driving guidance system 525 and ambulatory guidance system 535. The user may input a destination using user interface 533. Guidance system 525, 535 provides guidance to that destination. In one embodiment, guidance system 525, 535 provides guidance to a designated parking location as well. The guidance system 535 also provides guidance back to the user's parked vehicle.

In one embodiment, mobile device 510 includes user transition identifier 530. User transition identifier 530 automatically identifies the user moving into and out of the vehicle. In one embodiment, user transition identifier 530 uses data from sensors 520, to detect the user getting into and out of the car. In one embodiment, the determination may be made based on user movements, such as the characteristic movement associated with sitting down or getting up from a sitting position. In one embodiment, the determination may be made based on speed and dimensionality of movement. Someone riding a vehicle moves in a very different pattern than someone walking or riding a bicycle. In one embodiment, user transition identifier 530 may be a selection made by a user via a user interface 533.

In one embodiment, the user transition identifier 530 identifies when the user transitions from the car to walking (or optionally on a bicycle, skateboard, or other similar human-powered device.) In one embodiment, user transition identifier 530 triggers the guidance system 525, 535 to switch between driving guidance 525 and ambulatory guidance 535.

In one embodiment, availability reporting system 540 receives parking spot data from parking server 550, via server communication system 549. In one embodiment, this is provided in response to a request from the user. The request from the user may be initiated via user interface 533. In another embodiment, when the user reaches a destination, as guided by driving guidance system 525, the system automatically obtains the nearest available parking locations, and transitions to providing guidance to the parking location, unless the user stops the transition. In another embodiment, the system requests the guidance to the parking location prior to the user reaching their destination, when the destination does not have an associated parking structure or available parking. In this way, instead of the user having to drive past the destination, the user may directly go to a parking location.

In one embodiment, availability reporting system 540 obtains the available parking location(s), and passes the data to guidance system 525, 535, to provide guidance to the parking location.

In one embodiment, availability reporting system 540 reports to parking server 550 when the user takes a parking location, and when the user leaves the parking location. This enables the parking server 550 to have up-to-date information about what parking spots are available and which are taken. In one embodiment, the camera sensor 520 is used to provide additional information about parking spots that are not occupied by the user.

In one embodiment, the system may include an integrated billing system 545, which enables the user to pay for parking costs directly from the mobile device 510. In one embodiment, this may be integrated with a traditional parking facility system, and the payment may be via a terminal interacting with the mobile device 510. In another embodiment, the user may simply authorize an automatic debiting of parking charges from an account. In one embodiment, the integrated billing system 545 does not require user interaction. The system automatically completes the transaction when the user leaves the parking spot. The integrated billing system 545 interacts with integrated billing service 570. In one embodiment, the user initially sets up the automatic billing for the integrated billing system. In one embodiment, entry of a password, biometric, or other type of authentication is needed before the mobile device's integrated billing system 545 may be used to pay for parking.

Parking server 550, in one embodiment, is implemented as a server, or distributed system. The parking server 550 may be a cloud based service.

Parking server 550 tracks parking spot availability via parking spot availability tracker. The tracker 555 in one embodiment receives data from availability reporting systems 540 from a plurality of user mobile devices 510. In one embodiment the tracker 555 may also receive data from other sensors 580. These sensors 580 may include cameras, weight sensors, or other sensors that indicate whether various parking spots are available or occupied.

In one embodiment, for spots whose emptiness is based not on real data but on historical data—i.e., a user left that spot, and the system has not detected someone else parking in that spot—the vacancy probability calculator 560 calculates how likely it is that the spot is currently vacant. As noted above, in one embodiment, the vacancy probability calculator also calculates a cumulative probability of a vacant parking spot within a particular zone. The zone may be defined as a particular distance or a particular set of parking spots. For example, in a large parking structure, the zone may be a row of 20-30 parking spots.

The available sport identifier 565 uses the parking spot availability tracker 555, and the user's location data from location system 515, to identify an available spot. The "availability" of the spot is defined as the probability of a spot being available in the zone being above a threshold. In one embodiment, if there is no parking spot vacancy with a probability above a threshold, the next highest probable option is selected.

The available spot identifier 565 communicates the location of the destination spot to the mobile device 510, via communication system 575. The mobile device 510 then uses guidance system 525, 535 to guide the user to the identified parking spot. As discussed above, in one embodiment the availability reporting system 540 indicates when the user then utilizes the parking spot. In one embodiment, when the user accepts the directions to the nearest available spot, as identified by parking server 550, the availability reporting system 540 indicates that this spot is now claimed, though not occupied. In one embodiment, the system flags the claimed spot, and does not guide any new users to the spot, until the original user either parks in the spot or passes on the spot. In this way, the system attempts to ensure that the user is guided to a spot that is actually open, that spots are utilized at a maximum rate, and that the user's experience is positive.

In one embodiment, if parking server 550 supports a plurality of parking location providers, the available spot identifier 565 may balance guidance of users between the plurality of location providers. In one embodiment, the available spot identifier 565 may use one or more factors in selecting a spot, in addition to proximity. These factors may include balancing customers between a plurality of parking locations, revenue, expected future parking demand, and optionally other factors. Thus, the available spot identifier 565 identifies an optimal spot, though it may not be the spot nearest the user. In one embodiment, the status of the user requesting the spot may also influence the selection. For example, in one embodiment, a subscriber may be guided to a better spot than a free user.

Figure 6:
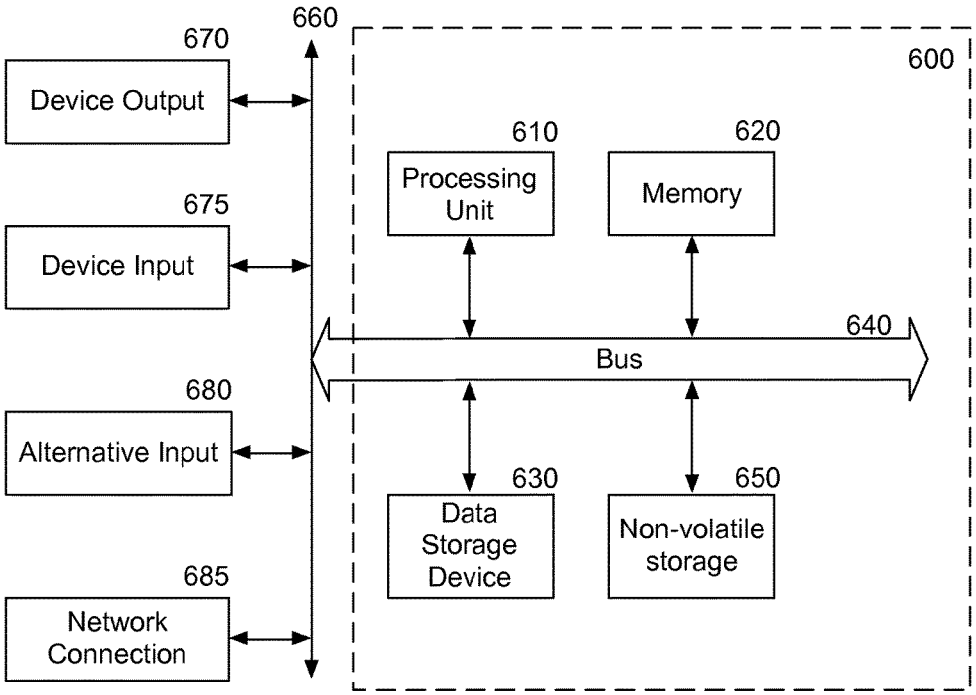
FIG. 6 is a block diagram of one embodiment of a computer system that may be used with the present invention.

FIG. 6 is a block diagram of a particular machine that may be used with the present invention. It will be apparent to those of ordinary skill in the art, however that other alternative systems of various system architectures may also be used.

The data processing system illustrated in FIG. 6 includes a bus or other internal communication means 640 for communicating information, and a processing unit 610 coupled to the bus 640 for processing information. The processing unit 610 may be a central processing unit (CPU), a digital signal processor (DSP), or another type of processing unit 610.

The system further includes, in one embodiment, a random access memory (RAM) or other volatile storage device 620 (referred to as memory), coupled to bus 640 for storing information and instructions to be executed by processor 610. Main memory 620 may also be used for storing temporary variables or other intermediate information during execution of instructions by processing unit 610.

The system also comprises in one embodiment a read only memory (ROM) 650 and/or static storage device 650 coupled to bus 640 for storing static information and instructions for processor 610. In one embodiment, the system also includes a data storage device 630 such as a magnetic disk or optical disk and its corresponding disk drive, or Flash memory or other storage which is capable of storing data when no power is supplied to the system. Data storage device 630 in one embodiment is coupled to bus 640 for storing information and instructions.

The system may further be coupled to an output device 670, such as a cathode ray tube (CRT) or a liquid crystal display (LCD) coupled to bus 640 through bus 660 for outputting information. The output device 670 may be a visual output device, an audio output device, and/or tactile output device (e.g. vibrations, etc.)

An input device 675 may be coupled to the bus 660. The input device 675 may be an alphanumeric input device, such as a keyboard including alphanumeric and other keys, for enabling a user to communicate information and command selections to processing unit 610. An additional user input device 680 may further be included. One such user input device 680 is cursor control device 680, such as a mouse, a trackball, stylus, cursor direction keys, or touch screen, may be coupled to bus 640 through bus 660 for communicating direction information and command selections to processing unit 610, and for controlling movement on display device 670.

Another device, which may optionally be coupled to computer system 600, is a network device 685 for accessing other nodes of a distributed system via a network. The communication device 685 may include any of a number of commercially available networking peripheral devices such as those used for coupling to an Ethernet, token ring, Internet, or wide area network, personal area network, wireless network or other method of accessing other devices. The communication device 685 may further be a null-modem connection, or any other mechanism that provides connectivity between the computer system 600 and the outside world.

Note that any or all of the components of this system illustrated in FIG. 6 and associated hardware may be used in various embodiments of the present invention.

It will be appreciated by those of ordinary skill in the art that the particular machine that embodies the present invention may be configured in various ways according to the particular implementation. The control logic or software implementing the present invention can be stored in main memory 620, mass storage device 630, or other storage medium locally or remotely accessible to processor 610.

It will be apparent to those of ordinary skill in the art that the system, method, and process described herein can be implemented as software stored in main memory 620 or read only memory 650 and executed by processor 610. This control logic or software may also be resident on an article of manufacture comprising a computer readable medium having computer readable program code embodied therein and being readable by the mass storage device 630 and for causing the processor 610 to operate in accordance with the methods and teachings herein.

The present invention may also be embodied in a handheld or portable device containing a subset of the computer hardware components described above. For example, the handheld device may be configured to contain only the bus 640, the processor 610, and memory 650 and/or 620.

The handheld device may be configured to include a set of buttons or input signaling components with which a user may select from a set of available options. These could be considered input device #1 675 or input device #2 680. The handheld device may also be configured to include an output device 670 such as a liquid crystal display (LCD) or display element matrix for displaying information to a user of the handheld device. Conventional methods may be used to implement such a handheld device. The implementation of the present invention for such a device would be apparent to one of ordinary skill in the art given the disclosure of the present invention as provided herein.

The present invention may also be embodied in a special purpose appliance including a subset of the computer hardware components described above, such as a kiosk or a vehicle. For example, the appliance may include a processing unit 610, a data storage device 630, a bus 640, and memory 620, and no input/output mechanisms, or only rudimentary communications mechanisms, such as a small touch-screen that permits the user to communicate in a basic manner with the device. In general, the more special-purpose the device is, the fewer of the elements need be present for the device to function. In some devices, communications with the user may be through a touch-based screen, or similar mechanism. In one embodiment, the device may not provide any direct input/output signals, but may be configured and accessed through a website or other network-based connection through network device 685.

It will be appreciated by those of ordinary skill in the art that any configuration of the particular machine implemented as the computer system may be used according to the particular implementation. The control logic or software implementing the present invention can be stored on any machine-readable medium locally or remotely accessible to processor 610. A machine-readable medium includes any mechanism for storing information in a form readable by a machine (e.g. a computer). For example, a machine readable medium includes read-only memory (ROM), random access memory (RAM), magnetic disk storage media, optical storage media, flash memory devices, or other storage media which may be used for temporary or permanent data storage. In one embodiment, the control logic may be implemented as transmittable data, such as electrical, optical, acoustical or other forms of propagated signals (e.g. carrier waves, infrared signals, digital signals, etc.).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A method of managing a parking system comprising:
receiving a request for a parking location for a vehicle from a mobile device;
calculating availability probabilities for a plurality of potentially available spots;
selecting one potentially available spot from the plurality of potentially available spots for the vehicle based on a combination of a subscription status of the user, the availability probability, a location of the vehicle, and a destination;
guiding the vehicle to the potentially available spot;
detecting when a user stops driving, and gets out of the vehicle at an actual parking spot; and
marking the actual parking spot as occupied;
wherein calculating the availability probability is based on a time since the potentially available parking spot was marked available.

2. The method of claim 1, wherein the marking comprises:
marking the actual parking spot as occupied; and
marking a location of the actual parking spot in a guidance system to provide directions to the user back to the actual parking spot.

3. The method of claim 1, wherein receiving a request comprises determining that the user has arrived at a designated destination, and determining that the user needs to park.

4. The method of claim 3, further comprising:
providing ambulatory guidance to the user, from the parking spot to the designated destination.

5. The method of claim 3, wherein the determining comprises receiving an indication from the user requesting a parking location.

6. The method of claim 1, wherein identifying the available spot comprises:
receiving data about a user's destination;
identifying one or more potential spots within a reasonable distance of the user's destination; and
selecting the available spot from the one or more potential spots based on a factor.

7. The method of claim 6, wherein the factor comprises proximity to the user's destination.

8. The method of claim 1, further comprising:

providing guidance to the actual parking spot for the user; and making the parking spot as available when the user leaves the parking spot.

9. The method of claim 1, further comprising:

when the user leaves the parking spot, marking the parking spot as available.

10. A parking system comprising:

a communication system in a mobile device to send a request for a parking location for a vehicle and to receive information regarding a selected available spot, the probable available spot selected based from a plurality of potentially available spots based on a calculation of availability probability for the plurality of potential spots and a location of the vehicle, wherein the availability probability is calculated based on a subscription status of the user, a time since the spot was marked available;

a driving guidance system configured to guide a user to the selected available spot;

user transition identifier to use data from one or more sensors to detect when the user stops driving, and gets out of the vehicle at a parking spot; and ambulatory guidance system to mark the parking spot as occupied, and calculate a return path to the parking spot for the user.

11. The parking system of claim 10, further comprising:

the communication system to send the parking spot to a parking server, the parking server to mark the parking spot as occupied.

12. The parking system of claim 10, wherein the request is sent in response to determining that the user has arrived at a designated destination, and determining that the user needs to park.

13. The parking system of claim 12, further comprising:

the ambulatory guidance system further to provide ambulatory guidance to the user from the parking spot to the designated destination.

14. The parking system of claim 12, wherein the determining comprises receiving an indication from the user requesting a parking location.

15. The parking system of claim 10, wherein a server provides the available spot by identifying one or more potential spots within a reasonable distance of the user's destination, and selecting the available spot from the one or more potential spots based on a factor.

16. The parking system of claim 10, wherein the factor comprises proximity to the user's destination.

17. The parking system of claim 10, further comprising:

the ambulatory guidance system to provide guidance to the marked parking spot for the user; and the communication system to send data marking the parking spot as available to the server when the user leaves the parking spot.

18. The parking system of claim 10, further comprising:

the communication system further to automatically receive a bill for the parking from an integrated billing service which calculates a time between when the user parked in the parking spot and when the user left the parking spot.

19. A parking server comprising:

a communication logic to receive a request for a parking spot from a user device;

a spot vacancy calculator to calculate an availability probability for a plurality of potentially available parking spots, the availability probability based on time since the parking spot was marked available;

an available spot identifier to identify the plurality of potentially available parking spots for the user, and select one potentially available parking spot based on: a subscription status of the user, a destination of the user, a location of the user, and the availability probability of the potentially available parking spot;

the communication logic to provide a location of the potentially available parking spot to a guidance system in the user device;

a driving guidance system configured to guide a user to the potentially available spot;

the communication system receiving information about an actual parking spot from the user device, the actual parking spot identified based on a location where the user stopped driving and got out of the vehicle at; and a parking spot availability tracker to mark the actual parking spot as occupied.

20. The parking server of claim 19, further comprising:

an integrated billing service to calculate a time between when the user parked in the parking spot and when the user left the parking spot, and automatically complete billing.

21. The parking system of claim 10, further comprising:

upon marking the parking location as occupied in the ambulatory guidance system, the communication logic to communicate to a server that the parking location is occupied.

* * * * *